US006594921B2

(12) United States Patent
Laio et al.

(10) Patent No.: US 6,594,921 B2
(45) Date of Patent: Jul. 22, 2003

(54) SHOE WITH A PIVOTAL COUNTER PORTION

(75) Inventors: Yui Laio, Taichung Hsien (TW); David Chang, No. 723-1, Fu-Hsing Rd., Tsao-Tun Chen, Nan-Tou Hsien (TW)

(73) Assignee: David Chang, Nan-Tou Hsien (TW)

( * ) Notice: Subject to any disclaimer, the term of this patent is extended or adjusted under 35 U.S.C. 154(b) by 4 days.

(21) Appl. No.: 09/899,388

(22) Filed: Jul. 5, 2001

(65) Prior Publication Data

US 2002/0095823 A1 Jul. 25, 2002

(30) Foreign Application Priority Data

Sep. 18, 2000 (TW) ..... 89216064 U

(51) Int. Cl.[7] ..... A43B 21/00
(52) U.S. Cl. ..... 36/138; 36/105; 36/50.1
(58) Field of Search ..... 36/138, 105, 69, 36/50.1

(56) References Cited

U.S. PATENT DOCUMENTS

| | | | | | |
|---|---|---|---|---|---|
| 1,216,579 | A | * | 2/1917 | Lemieux | 36/85 |
| 2,452,502 | A | * | 10/1948 | Tarbox | 36/87 |
| 2,568,974 | A | | 9/1951 | Tarbox | 36/12 |
| 3,146,535 | A | * | 9/1964 | Owings | 36/7.3 |
| 3,192,651 | A | * | 7/1965 | Smith | 36/105 |
| 3,975,838 | A | | 8/1976 | Martin | 36/121 |
| 4,095,356 | A | | 6/1978 | Robran et al. | 36/121 |
| 5,127,170 | A | | 7/1992 | Messina | 36/105 |
| 5,184,410 | A | * | 2/1993 | Hamilton | 36/105 |
| 5,282,327 | A | * | 2/1994 | Ogle | 36/138 |
| 5,481,814 | A | * | 1/1996 | Spencer | 36/138 |
| 6,189,239 | B1 | * | 2/2001 | Gasparovic et al. | 36/102 |

FOREIGN PATENT DOCUMENTS

| | | | |
|---|---|---|---|
| DE | 4107376 A1 | 3/1992 | A43B/11/00 |

* cited by examiner

*Primary Examiner*—M. D. Patterson
(74) *Attorney, Agent, or Firm*—Thomas, Kayden, Horstemeyer & Risley LLP

(57) ABSTRACT

A shoe has a sole, an upper and a counter portion. The upper is securely connected to the sole and has a rear end defined with an opening. The counter portion is pivotally connected to a rear end of the sole to close the opening in the upper. A fastener is mounted on the upper and the pivotal counter portion to connect the pivotal counter portion to the rear end of the upper. Accordingly, a wearer's foot in the shoe can be vented. Also, for a pair of tied shoes with the pivotal counter portions can be put on or taken off without tying or untying the laces. The use of the shoe becomes more versatile and more convenient.

16 Claims, 9 Drawing Sheets

SHOE WITH A PIVOTAL COUNTER PORTION

BACKGROUND OF THE INVENTION

1. Field of the Invention

The present invention relates to a shoe having a pivotal counter portion with a lower end pivotally connected to a rear end of a sole, and upper ends of the counter portion detachably connected to upper ends of an opening in the upper.

2. Description of Related Art

Conventional footwear is an outer covering for the human foot typically having a thick or stiff sole with an attached heel and an upper attached to the sole. Besides protecting the foot, shoes have for centuries been a fashion item. Therefore, there are various types of shoes available, for example: boots, high-heeled shoes, court shoes, training shoes, tennis shoes, wooden shoes, sandals, etc. Most formal shoes are shoes with continuous uppers, which include a toe cup, a vamp and quarter and counter portions. These shoes with continuous uppers are often worn by people for more than eight hours per day. Even though shoes are designed and made to suit people's feet, it is uncomfortable to wear a pair of shoes with continuous uppers for a long time. However, to take off shoes to air the feet is rather unsightly behavior in many formal places.

However, in some places, customs or hygiene requirements dictate that people take off their shoes before entering a room, etc. In these cases, a pair of shoes with tied laces will cause people to have to take a lot of time to tie and untie the laces. Furthermore, it is difficult for children to deal with laces.

Therefore, it is an objective of the invention to provide a shoe with a pivotal counter portion to mitigate or obviate the aforementioned problems.

SUMMARY OF THE INVENTION

An object of the present invention is to provide a shoe with a pivotal counter portion that can be pivotally detached from the upper or completely detached from the sole thereby converting the shoe to a "mule" or "clog" style shoe. The shoe has a sole, an upper and a counter portion. The upper is securely attached to the sole and has an open rear end in the style of a "mule" or a "clog". The counter portion is pivotally connected to a rear end of the sole to close the opening in the upper. A fastener is securely attached to each side of the upper and each side of the counter portion to connect the counter portion to the upper. Releasing the counter portion allows the foot in the shoe to air out, and a pair of tied shoes with the pivotal counter portions can be put on or taken off without tying or untying the laces. The use of the shoe becomes more versatile and more convenient.

Other objects, advantages and novel features of the invention will become more apparent from the following detailed description when taken in conjunction with the accompanying drawings.

DETAILED DESCRIPTION OF THE PREFERRED EMBODIMENT

Figure 1:
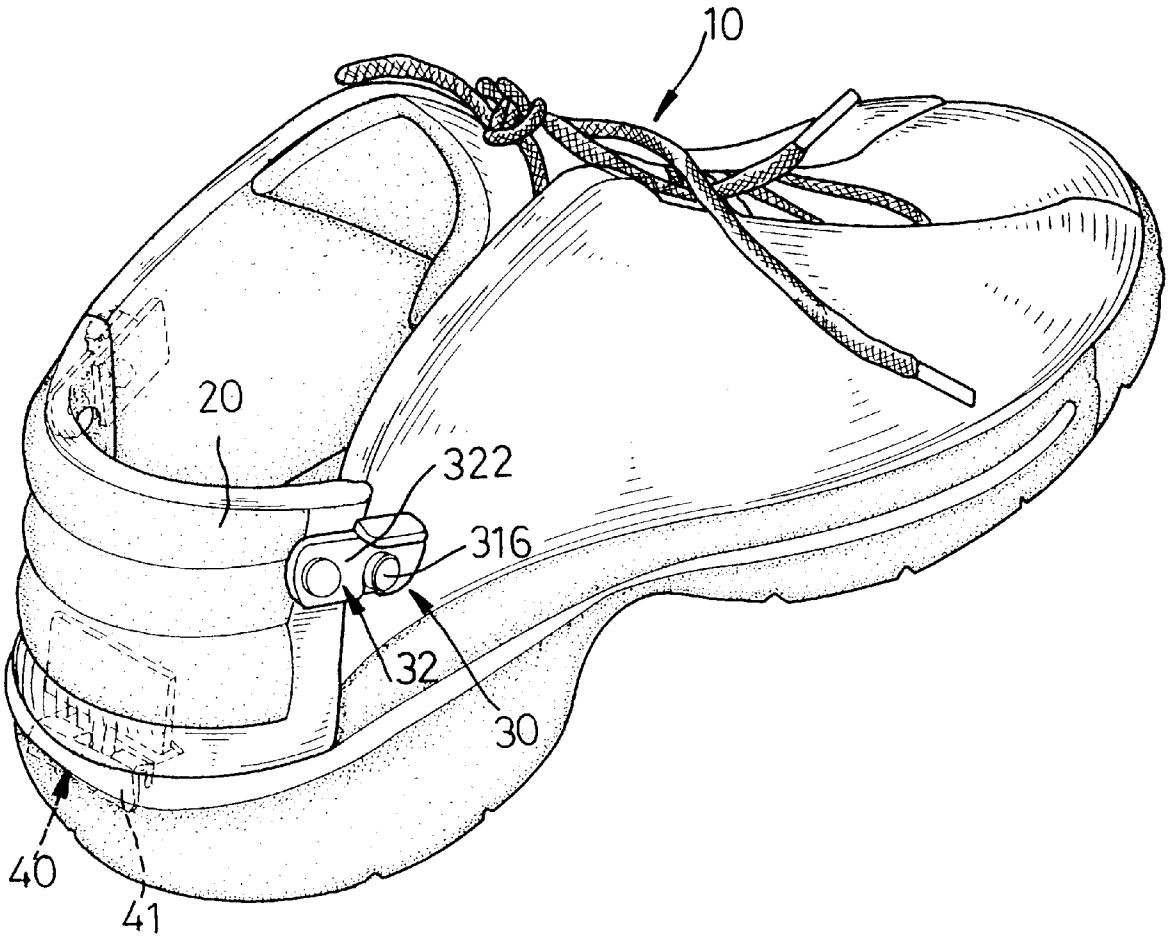
FIG. 1 is a perspective view of a shoe with a pivotal counter portion in accordance with the present invention.
Figure 2:
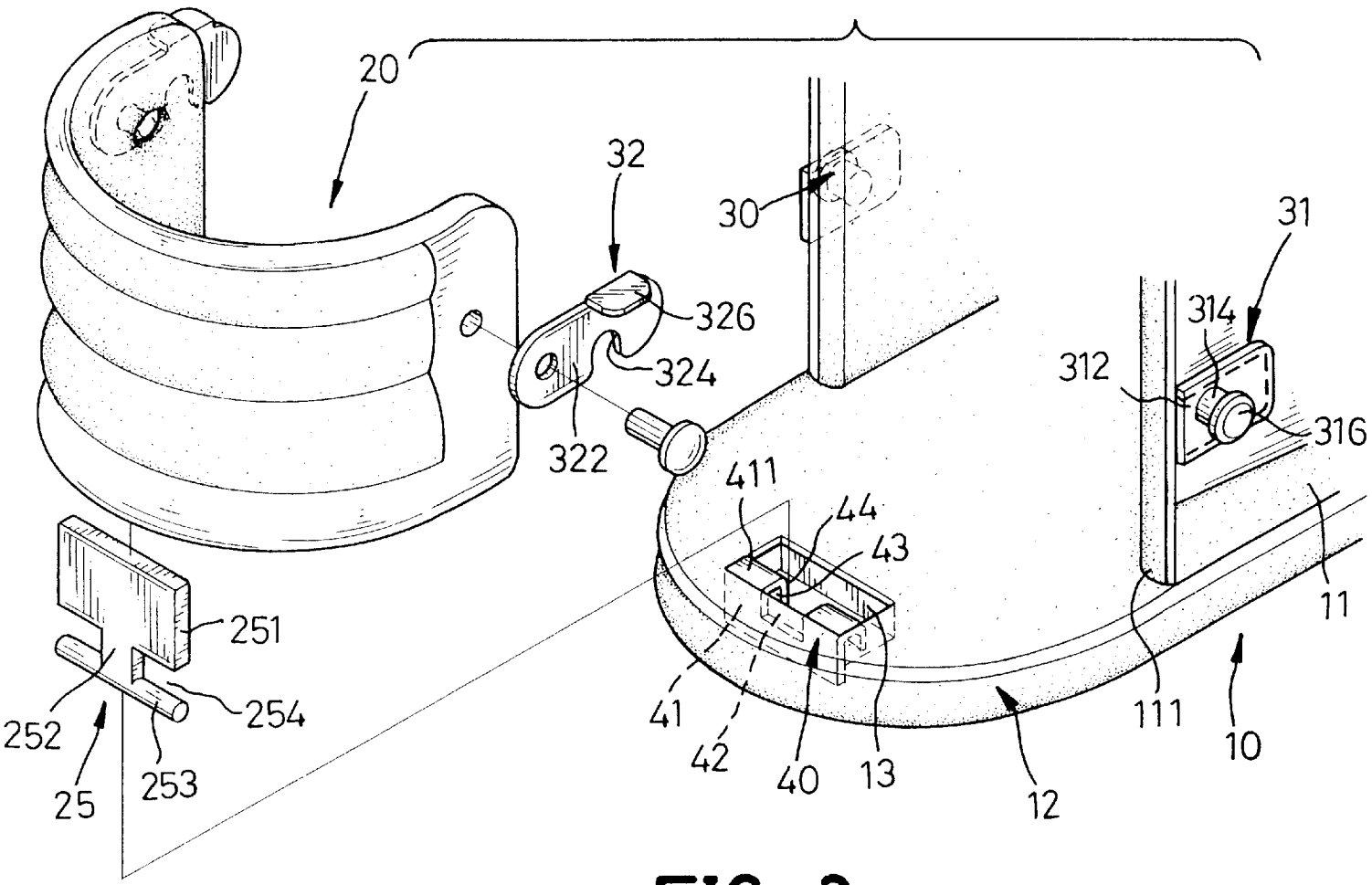
FIG. 2 is an enlarged exploded perspective view of the counter portion of the shoe in FIG. 1.
Figure 3:
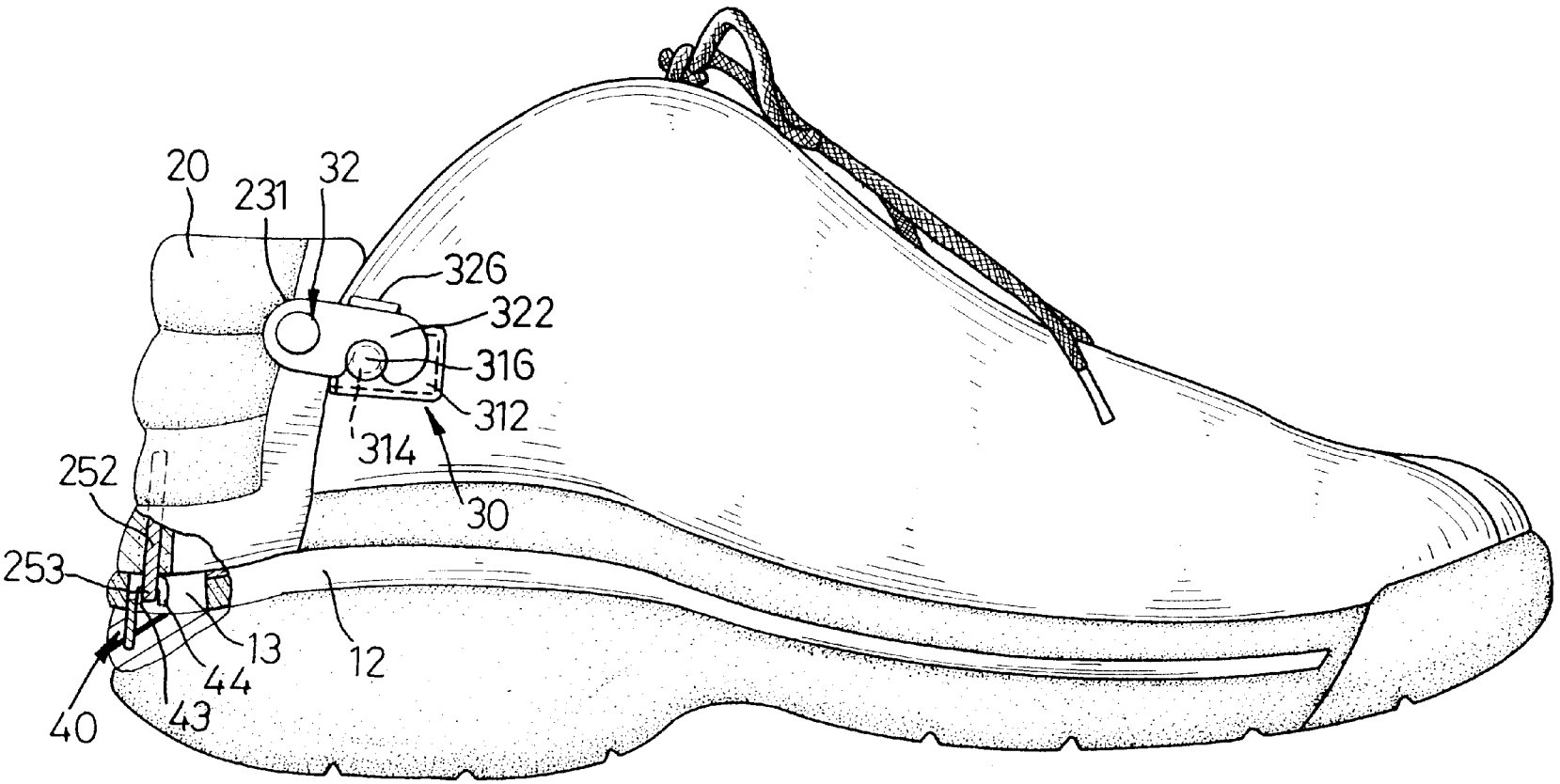
FIG. 3 is a side plan view in partial section of the shoe in FIG., 1.

With reference to FIGS. 1, 2 and 3, the present invention relates to a shoe (10) having a pivotal counter portion (20). The shoe (10) comprises an upper (11) securely connecting to a sole (12). The upper (11) is particularly defined with an opening (111) at a rear end of the upper (11). The pivotal counter portion (20) is optionally connected over the opening (111) of the shoe (20). Fasteners (30) such as a locking arm fastener, a clip fastener, a belt fastener, etc. are symmetrically mounted on upper ends of two opposite sides of the opening (111) and the pivotal counter portion (20). The pivotal counter portion (20) is pivotally connected to a rear end of the sole (12) by means of a pivotal connector (25). The sole (12) has a recess (13) defined in an upper surface near the rear end of the sole (12). A pivot latch (40) is securely mounted in the recess (13).

The connector (25) has a body (251), a longitudinal neck (252) and a transverse pivot pin (253). The body is (251) securely mounted in the counter portion (20). The longitudinal neck (252) is integrally formed at a lower end of the body (251). The transverse pivot pin (253) is integrally formed at a lower end of the neck (252). Two gaps (254) are respectively defined on opposite sides of the neck (252).

The pivot latch (40) is formed as an inverted J-shaped bracket (41). The bracket (41) has an upper horizontal retainer (411) flush with the upper surface of the sole (12). A slot (42) is defined in a middle of the bracket (41), divides the horizontal retainer (411) into two matching pieces and corresponds to the neck (252) of the connector (25). Lips (44) are integrally formed at and extend down perpendicular from an outer edge of each horizontal retainer (411). The lips (44), horizontal retainers (411) and bracket (41) define a pivot socket (43) to pivotally hold the pivot pin (253) in the pivot latch (40).

Accordingly, the pivot pin (253) of the connector (25) can be inserted into the recess (13) and pivotally mounted in the pivot socket (43) of the pivot latch (40).

With reference to FIGS. 1–4, each fastener (30) comprises a first connecting member (31) and a second connecting member (32). The first connecting member (31) is securely attached to the upper (11) near the opening (111) in the shoe (10). The second connecting member (32) is securely attached to the pivotal counter portion (20) at a position corresponding to and aligning with the first connecting member (31) when the pivotal connecting portion (20) closes the opening (111) in the upper (11). When the pivotal counter portion (20) is pivotally mounted in the pivot latch (40), the first connecting member (31) and the second connecting member (32) detachably connect to each other to securely hold the pivotal counter portion (20) in place over the opening (111) in the upper (11). The first connecting member (31) can be disconnected from the second connecting member (32) so the pivotal counter portion (20) can be pivoted to expose the opening (111) in the upper (11) or be removed from the shoe (10) completely by further disengaging the connector (25) from the pivot latch (40).

With reference to FIGS. 1–6, a first embodiment of the fastener (30) comprises first connecting members (31) comprising a base plate (312), a fastening lug (314) and a retaining head (316). The base plate (312) is securely attached to the upper (11). In practice, the base plate (312) can be selectively secured to the outer surface of the upper (11) or the inner surface of the upper (11). The base plate (312) can also be covered by the upper (11). The fastening lug (314) is integrally formed on the base plate (312) and extends out from the upper (11). The retaining head (33) is integrally formed at an outer end of the fastening lug (314).

Each one of the second connecting members (32) includes a connecting arm (322), at least one notch (324) and a tab (326). The connecting arm (322) is pivotally connected to the counter portion (20). Each notch (324) is defined in the connecting arm (322) and corresponds to the fastening lug (314). The tab (326) extends perpendicularly out from the top of the connecting arm (322).

When the counter portion (20) is connected to the sole (12) by means of the pivot pin (253) pivotally fitted in the pivot socket (43) of the pivot latch (40), the second connecting members (32) respectively catch lock with the fastening lugs (314). Consequently, the counter portion (20) is detachably connected with the upper (11) and the sole (12) to be a typically integrated shoe.

Figure 4:
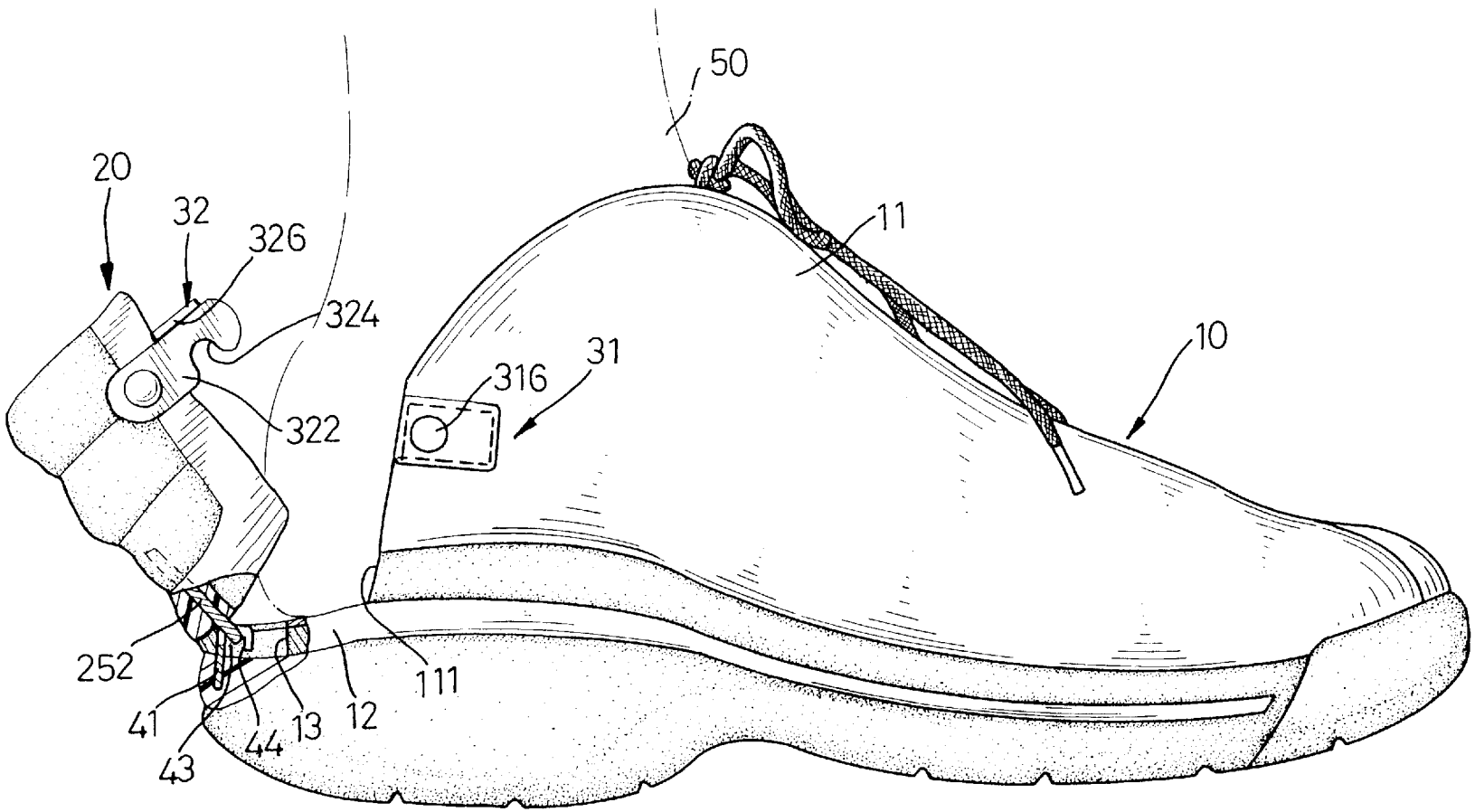
FIG. 4 is an operational side plan view in partial section of the shoe in FIG. 1, showing the counter portion being pivoted.

With reference to FIG. 4, when a user wants to open the counter portion (20) of the shoe (10), the second connecting members (32) on the counter portion (20) can be easily pulled up to release the second connecting members (32) from the fastening lugs (314) of the first connecting member (31). Thus the counter portion (20) is then pivotally opened, and a foot (50) of the user can be easily removed from or inserted into the shoe (10).

Figure 5:
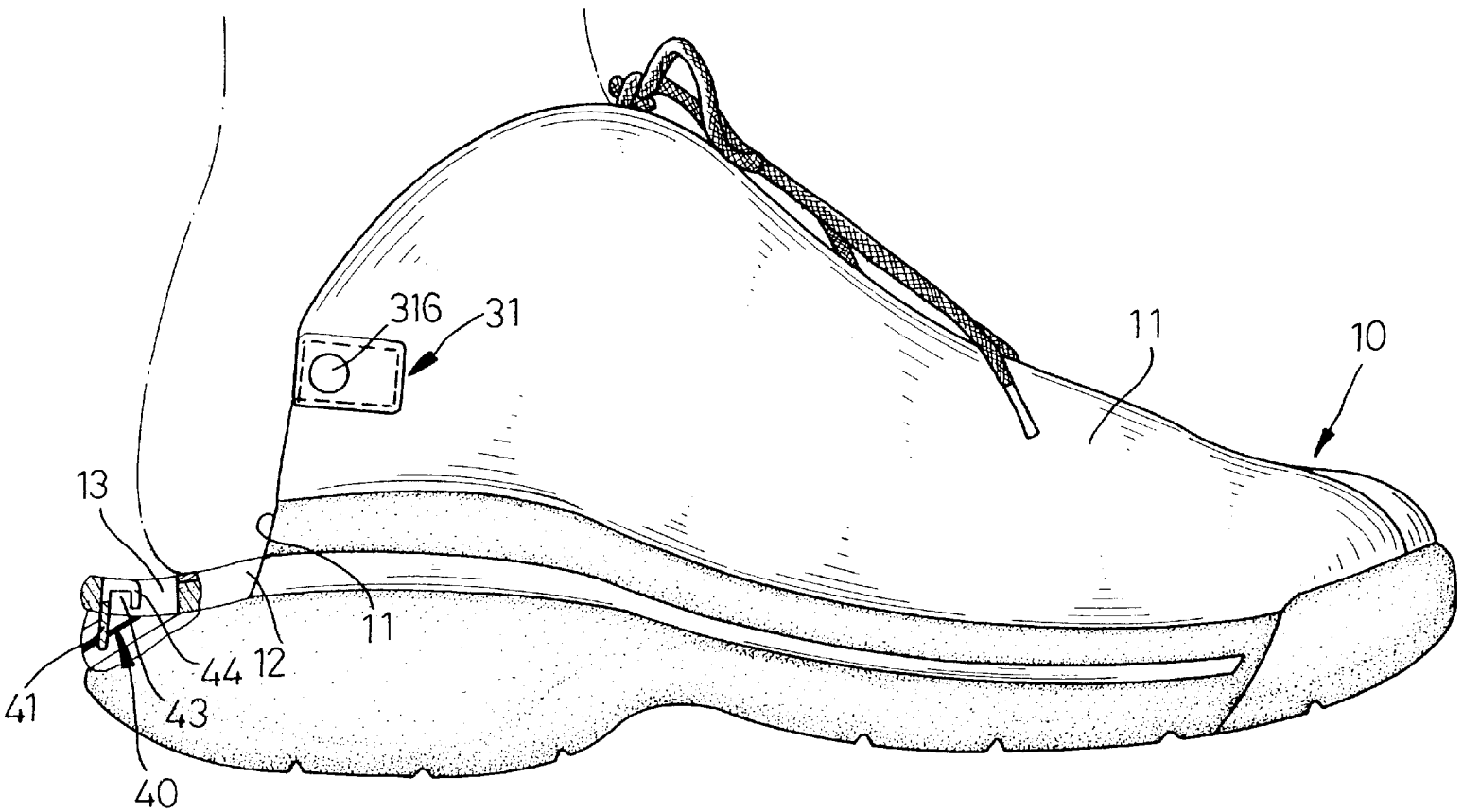
FIG. 5 is a side plan view in partial section of the shoe in FIG. 1, showing the counter portion completely removed from the shoe.

With reference to FIG. 5, the counter portion (20) can be completely detached from the sole (12) to change the style of the shoe (10) to a "mule" or "clog" style shoe.

Figure 6:
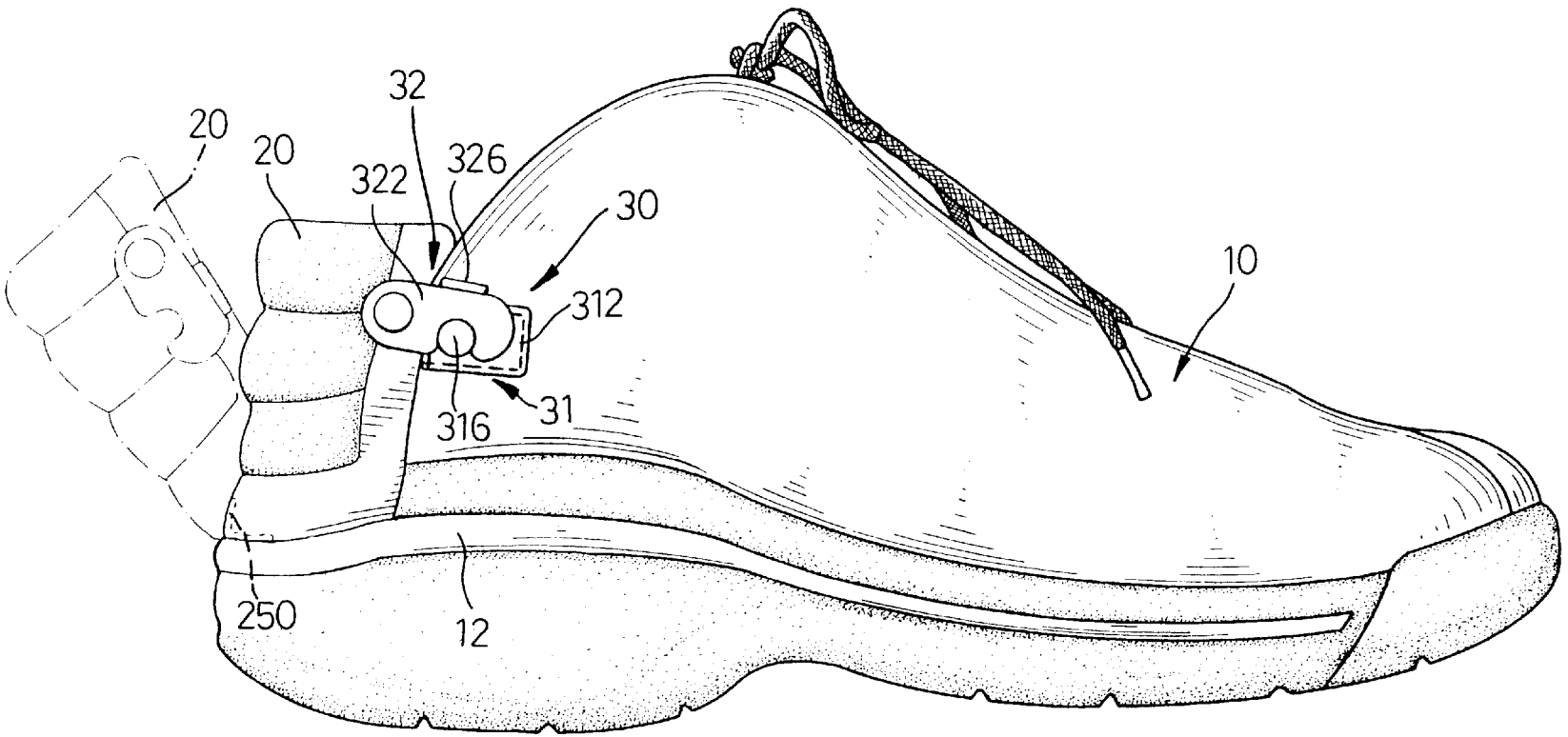
FIG. 6 is an operational side plan view of another embodiment of a connecting means of the counter portion of the shoe with a pivotal counter portion in accordance with the present invention.

With reference to FIG. 6, another embodiment of the connector of the counter portion (20) to the sole (12) comprises a connecting piece (250) made of a flexible piece of fabric, plastic or other material. The connecting piece (250) has an upper end sewn to the lower end of the counter portion (20) and a lower end sewn to the sole (12).

Figure 7:
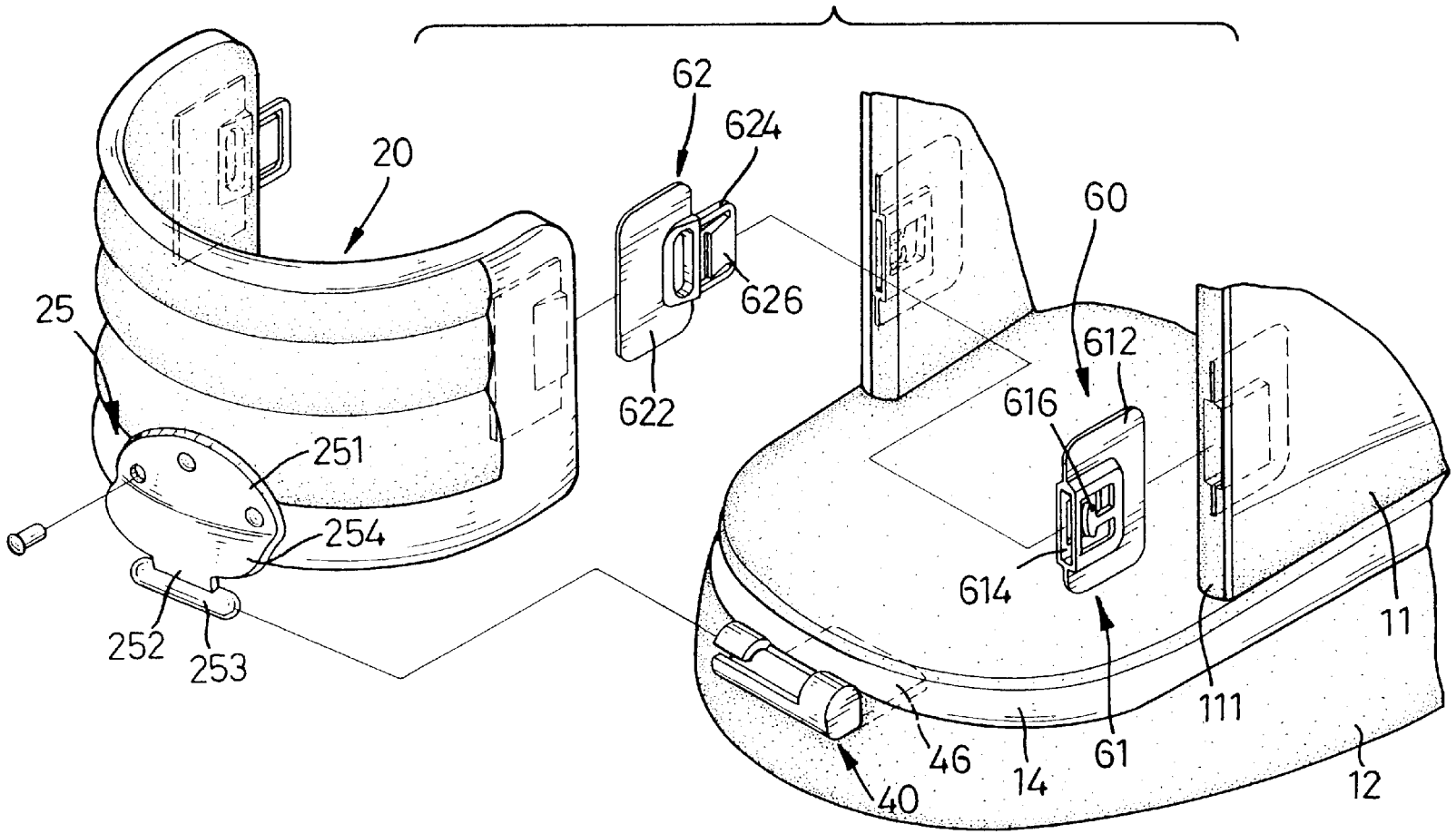
FIG. 7 is an exploded perspective view of a second embodiment of a shoe with a pivotal counter portion in accordance with the present invention.

With reference to FIG. 7, another embodiment of the connector (25) has a curved portion (254) integrally formed between the body (251) and the neck (252) to fit with a pad (14) mounted on the sole (12).

The pivot latch (40) is connected to a plate (46) inserted into the rear end of the sole (12), such that the pivot latch (40) is exposed from the sole (12) to engage with the connector (25).

With further reference to FIG. 7, a second embodiment of the fasteners (60) comprises a first connecting member (61) and a second connecting member (62). Each first connecting member (61) is securely attached to the upper (11). Each first connecting member (61) has a base plate (612) selectively attached to an outer surface, an inner surface of the upper (11) or inside the upper (11). A socket (614) is defined in one side of the base plate (612). A resilient pushing block (616) is formed on the base plate (612).

Each second connecting member (62) is selectively attached to the outer surface, inner surface of the counter portion (20) or inside the counter portion (20). Each second connecting member (62) has a base plate (622) that can be connected to the counter portion (20). A plug (624) is formed on one side of the base plate (622) and exposed from the counter portion (20). A resilient block (626) is formed on the plug (624). When the plug (624) is inserted into the socket (614) in the corresponding first connecting member (61). The resilient block (626) will engage with the socket (614). When the user pushes the resilient pushing block (616) from the outer surface of the upper (11), the resilient block (626) will disengage from the socket (614).

Figure 8:
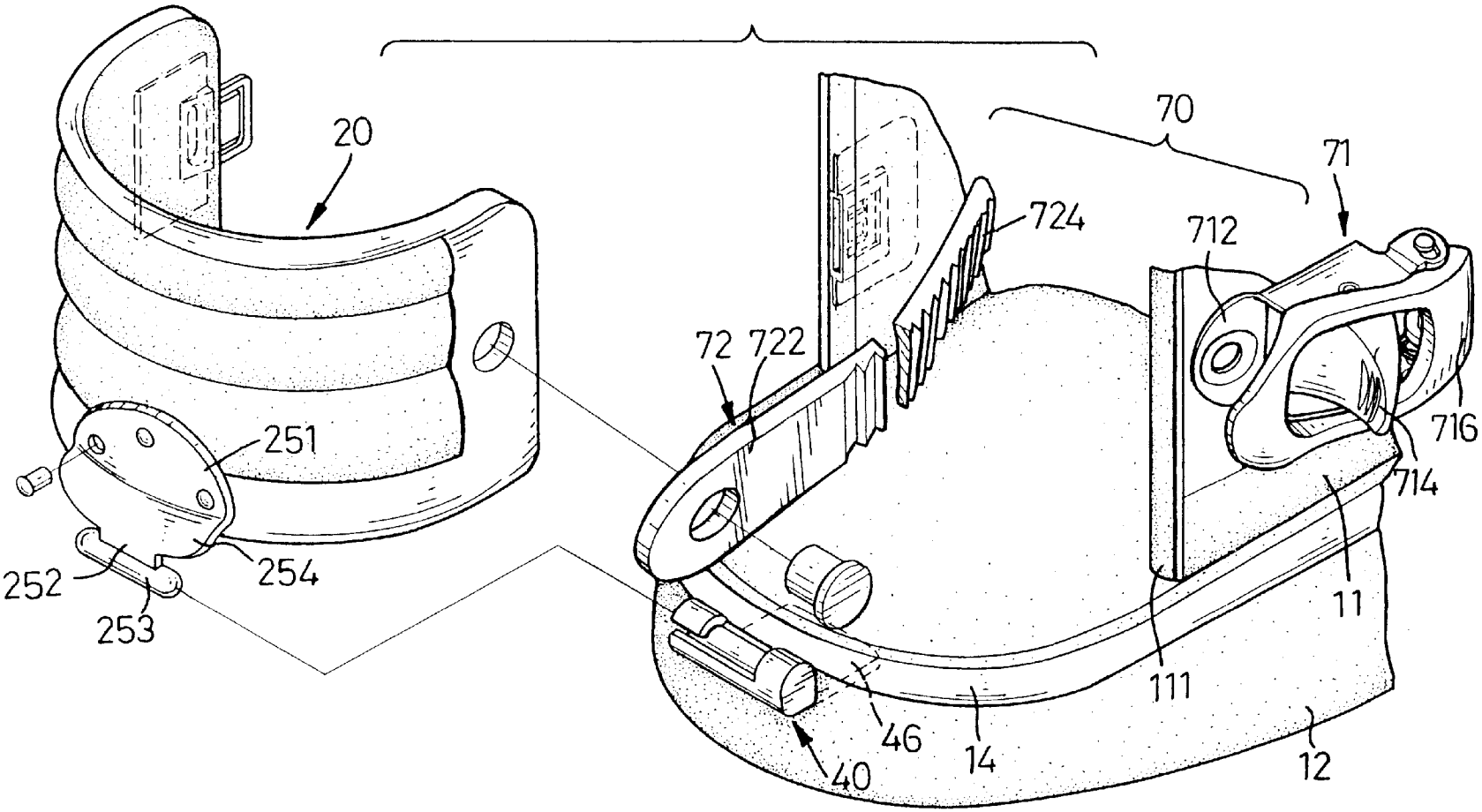
FIG. 8 is an exploded perspective view of a third embodiment of a shoe with a pivotal counter portion in accordance with the present invention.
Figure 9:
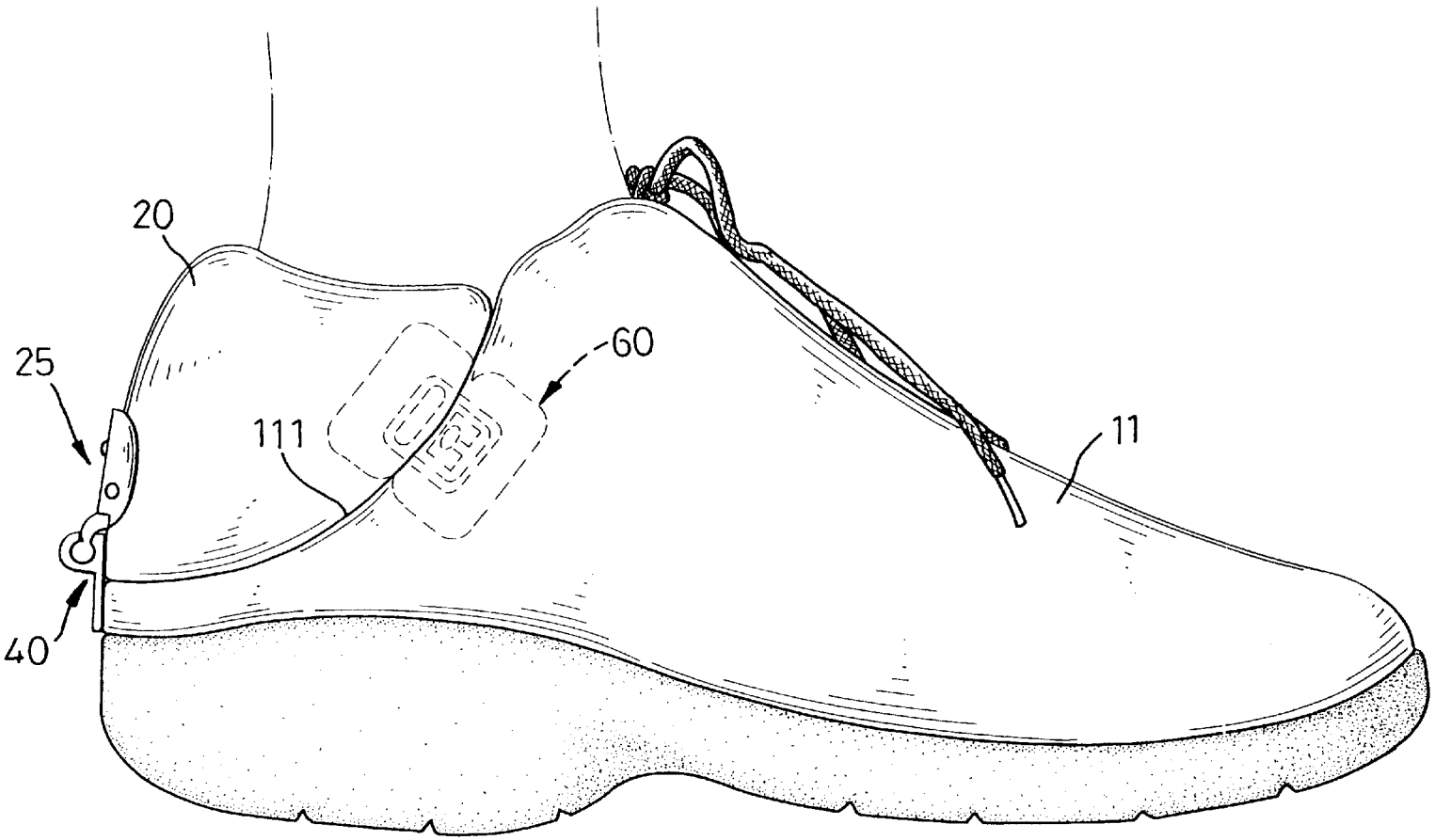
FIG. 9 is a side plan view of a fourth embodiment of a shoe with a pivotal counter portion in accordance with the present invention.

With reference to FIG. 8, a third embodiment of the fastener (70) comprises a first connecting member (71) and a second connecting member (72). The first connecting member (71) is attached to the outer surface of the upper (11). The first connecting member (71) has a base (712) attached to the upper (11). An engaging member (714) with teeth is pivotally mounted on the base (712) with a pivot pin (not shown). An adjusting member (716) with teeth is pivotally connected to the base (712) with a pivot pin (not shown). A spring (not shown) is mounted on each pivot pin to push the corresponding member (714, 716) to the base (712).

The second connecting member (72) is a strap (722) with multiple teeth (724) formed on one side of the strap (722). When the second connecting member (72) is inserted into the first connecting member (71) and the teeth on the engaging member (714) engage with the teeth (724) on the strap (722), the second connecting member (72) securely engages with the first connecting member (71). The opening in the upper (11) is closed with the counter portion (20). When the adjusting member (716) is pulled, the teeth on the adjusting member (716) will engage with the teeth (724) on the strap (722). The strap (722) is pushed to move relative to the base (712) so the engagement between the second connecting member (72) and the first connecting member (71) is tightened.

With reference to FIG. 10, the pivotal counter (20) is connected to the upper (11) to close the opening (111).

The present invention has following advantages:

1. When a wearer's feet (50) become uncomfortable due to being enclosed in the shoes (10) for a long time, the second connecting members (32,62,72) are easily released the from the first connecting members (31,61, 71) by hand. The counter portion (20) is then pivotally opened or completely detached from the sole (12). The feet (50) are vented and relax.
2. For a pair of laced up shoes (10) with pivotal counter portions (20), it is convenient for a person to put on or take off the shoe (10) without having to tie or untie the laces.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A shoe with a pivotal counter portion comprising a sole with a rear end;

an upper securely connected to the sole and having a rear end with an opening defined it the rear end;

a counter portion with an outer surface pivotally connected to a rear end of the sole to close the opening in the upper; and a fastener symmetrically mounted on each upper end of two opposite sides of the opening and the pivotal counter portion to connect the counter portion to the rear end of the upper, wherein the each fastener comprises a first connecting member securely attached to the upper and a second connecting member securely attached to the pivotal counter portion at a position corresponding too the first connecting member to engage with the first connecting member;

a connector is attached to the counter portion;

a pivot latch is attached to the sole to pivotally engage with the connector so as to pivotally mount the counter portion to the sole;

the connector comprises:

a body securely attached to the counter portion; and a transversally extending pivot pin integrally connected to the body; and the pivot latch has a bracket exposed out from the rear end of the sole and comprises a pivot socket defined in the bracket to pivotally receive the pivot pin.

2. The shoe with a pivotal counter portion as claimed in claim 1, wherein the connector further comprises:

a longitudinal neck integrally formed at a lower end of the body, wherein the transversally extending pivot pin is integrally formed at a lower end of the neck; and two gaps respectively defined on opposite sides of the neck; and the pivot latch is formed as an inverted J-shaped bracket and further has an upper horizontal piece;

a slot defined in a middle of the J-shaped bracket and corresponding to the neck of the connector; and lips integrally formed at an outer end of the horizontal piece, wherein the body is securely attached to the outer surface of the counter portion; and the pivot socket is defined in the J-shaped bracket to pivotally receive the pivot pin, whereby the pivot pin of the connector can be inserted into the recess and pivotally fitted into the pivot socket of the pivot latch.

3. The shoe with a pivotal counter portion as claimed in claim 2, wherein a recess is defined in an upper surface near a rear end of the sole to receive the pivot latch.

4. The shoe with a pivotal counter portion as claimed in claim 3, wherein the upper horizontal retainer is flush with the upper surface of the sole.

5. The shoe with a pivotal counter portion as claimed in claim 2, wherein a pad is mounted on the sole; and a curve portion is integrally formed between the body and the neck to fit with a configuration of the pad.

6. The shoe with a pivotal counter portion as claimed in claim 2, wherein the pivot latch is connected to a plate inserted into a rear end of the sole; and the pivot latch is mounted on the rear end of the sole and exposed from the sole to engage with the connector.

7. The shoe with a pivotal counter portion as claimed in claim 1, wherein each first connecting member has:

a base plate securely attached to the upper;

a fastening lug integrally formed on the base plate; and a retaining head integrally formed at an outer end of the fastening lug; and each second connecting member has:

a connecting arm pivotally attached to the counter portion;

at least one notch defined in the connecting arm and corresponding to the fastening lug to engage with the fastening lug; and a tab perpendicularly extending out from the connecting arm.

8. The shoe with a pivotal counter portion as claimed in claim 7, wherein the base plate of each first connecting member is attached to an outer surface of the upper; and the base plate of each second connecting member is attached to an outer surface of the counter portion.

9. The shoe with a pivotal counter portion as claimed in claim 7, wherein the base plate of each fastener is mounted inside the upper; and the fastening lug is exposed from the upper to engage with the notch in the clip plate.

10. The shoe with a pivotal counter portion as claimed in claim 1, wherein each first connecting member has:

a base plate attached to the upper;

a socket defined in one side of the base plate; and a resilient pushing block formed on the base plate; and each second connecting member has:

a base plate attached to the counter portion;

a plug formed on one side of the base plate to be inserted into the socket; and a resilient block formed on the plug to engage with the socket.

11. The shoe with a pivotal counter portion as claimed in claim 10 wherein in the base plate of each first connecting member is inserted into the upper;

the socket is exposed from the upper; and the plug of each second connecting member is exposed from the counter portion to be inserted into the exposed socket.

12. The shoe with a pivotal counter portion as claimed in claim 11 wherein the base plate of each first connecting member is attached to an outer surface of the upper; and the base plate of each second connecting member is attached to an outer surface of the counter portion.

13. The shoe with a pivotal counter portion as claimed in claim 11 wherein the base plate of each first connecting member is attached to an inner surface of the upper; and the base plate of each second connecting member is attached to an inner surface of the counter portion.

14. The shoe with a pivotal counter portion as claimed in claim 1, wherein each first connecting member has:

a base attached to the upper;

an engaging member with teeth pivotally mounted on the base with a pivot pin; and a spring mounted on the pivot pin to push the engaging member to the base;

and each second connecting member is a strap with multiple teeth formed on one side of the strap to engage with the teeth on the engaging member of the corresponding one of the first connecting members.

15. The shoe with a pivotal counter portion as claimed in claim 14, wherein an adjusting member with teeth is pivotally mounted on the base of each first connecting member with a pivot; and a spring mounted on the pivot to push the adjusting member to the base, whereby the engagement between the clip plate and the fastener will be tightened, when the adjusting member is pulled and the teeth on the adjusting member engages with the teeth on the strap.

16. The shoe with a pivotal counter portion as claimed in claim 14, wherein the base of each first connecting member is attached to an outer surface of the upper; and the strap of each second connecting member is attached to an outer surface of the counter portion.

* * * * *